United States Patent [19]

Biemiller

[11] 4,344,298

[45] Aug. 17, 1982

[54] ICE CUBE FORMING TRAY FOR ICE MAKING MACHINE

[76] Inventor: John E. Biemiller, 1 Black Oak La., Westminster, Md. 21157

[21] Appl. No.: 190,204

[22] Filed: Sep. 24, 1980

[51] Int. Cl.[3] ..... F25C 1/06

[52] U.S. Cl. ..... 62/347; 62/523; 165/115; 249/81

[58] Field of Search ..... 62/71, 73, 74, 347, 62/352, 515, 523, 348; 165/115, 116; 249/81, 132

[56] References Cited

U.S. PATENT DOCUMENTS

| | | | |
|---|---|---|---|
| 2,415,446 | 2/1947 | Shoemaker | 62/71 |
| 2,656,689 | 10/1953 | Muffly | 62/352 X |
| 2,674,858 | 4/1954 | Magnuson et al. | 62/135 |
| 2,729,070 | 1/1956 | Ames | 62/347 |
| 3,046,753 | 7/1962 | Carapico, Jr. | 62/132 |
| 3,130,556 | 4/1964 | Goldsborough | 62/73 |
| 3,187,516 | 6/1965 | Lundstrom | 62/138 |
| 3,206,944 | 9/1965 | Gallo | 62/347 |
| 3,280,588 | 10/1966 | Brindley | 62/340 |
| 3,430,452 | 3/1969 | Dedricks et al. | 62/138 |
| 3,538,720 | 11/1970 | Feola | 62/352 |
| 3,654,771 | 4/1972 | Kuebler | 62/352 |
| 3,913,349 | 10/1975 | Johnson | 62/352 |
| 4,255,941 | 3/1981 | Bouloy | 62/347 |

*Primary Examiner*—William E. Tapolcai, Jr.
*Attorney, Agent, or Firm*—Joseph P. Gastel

[57] ABSTRACT

An ice cube forming tray for an ice making machine consisting of a plurality of side-by-side corrugated plates having alternating ridges and grooves, straight plates separating the corrugated plates and also providing outer borders to the corrugated plates, and triangular evaporator coils located in complementary mating engagement in the apices of the ridges and passing through complementary mating openings in the plates. The plates which are not corrugated, instead of being straight, may be of hollow diamond-shape to also carry refrigerant.

20 Claims, 8 Drawing Figures

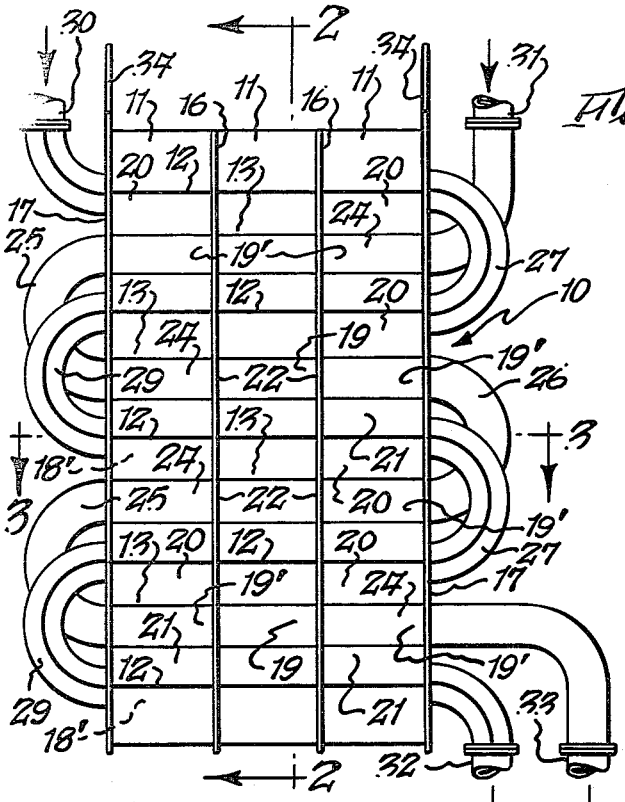
Fig. 1.
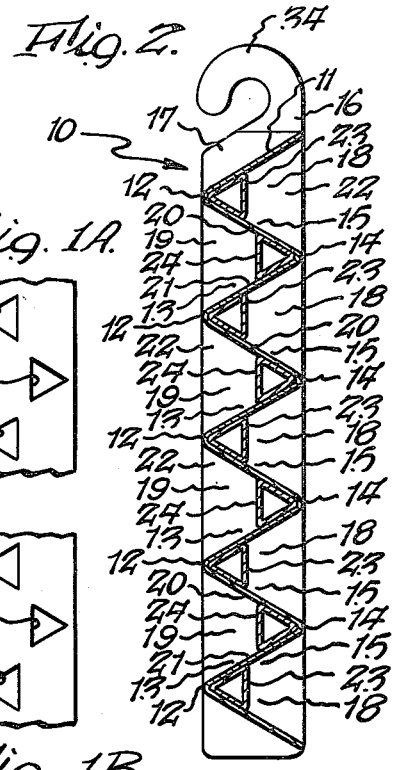
Fig. 2.
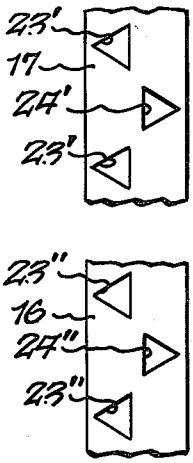
Fig. 1A.
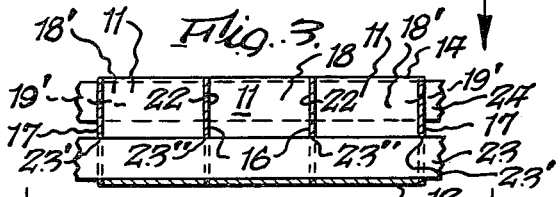
Fig. 3.
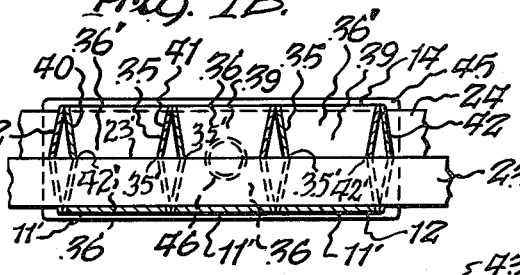
Fig. 1B.
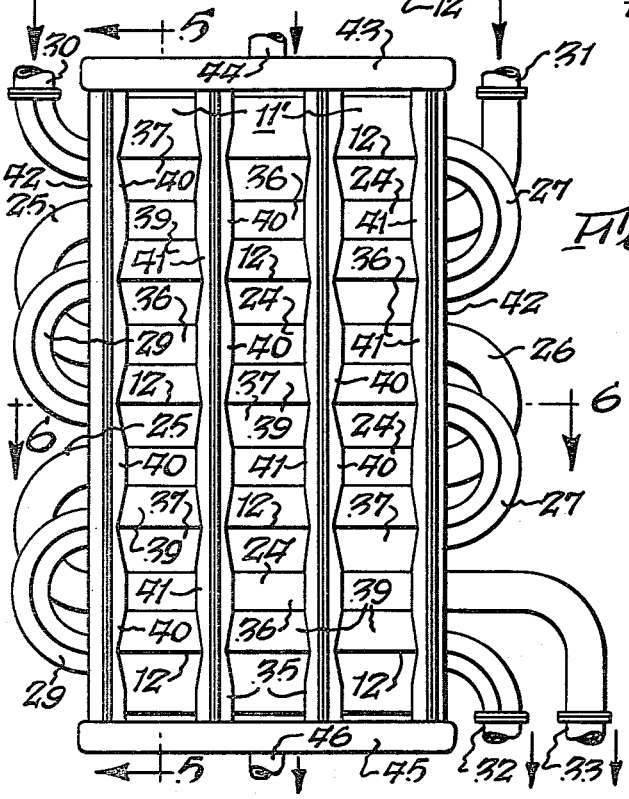
Fig. 4.
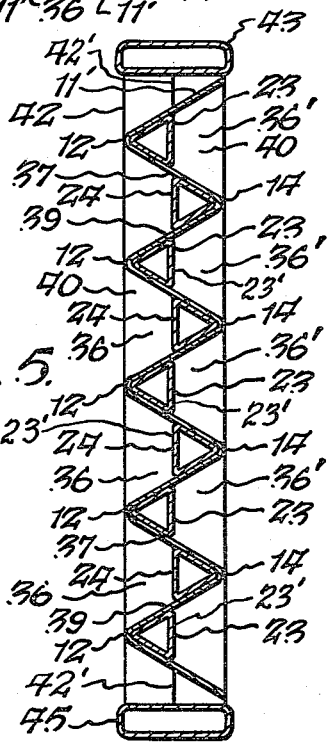
Fig. 6.
Fig. 5.

ICE CUBE FORMING TRAY FOR ICE MAKING MACHINE

BACKGROUND OF THE INVENTION

The present invention relates to an improved ice cube forming tray for an ice making machine.

By way of background, ice cube forming trays are known which have hollow walls surrounding the openings in which water is frozen, to thereby provide relatively efficient heat transfer. However, trays utilized in the past were relatively difficult to fabricate because of their complexity and thus they were relatively expensive. It is with overcoming this deficiency that the present invention is concerned.

SUMMARY OF THE INVENTION

It is accordingly one object of the present invention to provide an improved ice cube forming tray which not only forms ice cubes in openings which are in direct contact with refrigerant carrying conduits, but which is of a construction which permits it to be fabricated in a simple and inexpensive manner. Other objects and attendant advantages of the present invention will readily be perceived hereafter.

The present invention relates to an ice cube forming tray for an ice making machine comprising a plurality of members each formed to provide a plurality of aligned openings with alternating openings facing in opposite directions, first plate means located between adjacent members to provide first side walls, second plate means located at opposite outer sides of said plurality of members to provide second side walls, and a plurality of refrigerant-receiving evaporator tubes passing through said first and second plate means and being located in and forming the bottoms of said openings to provide direct engagement with water in said openings. Preferably the first and second plate means are hollow for receiving refrigerant and functioning as evaporator tubes to provide direct engagement with water in said openings. The present invention will be more fully understood when the following portions of the specification are read in conjunction with the accompanying drawings wherein:

BRIEF DESCRIPTION OF THE DRAWINGS

FIG. 1 is a plan view of the improved tray of the present invention;

FIGS. 1A and 1B are fragmentary side elevational views of the planar plates which are associated with the corrugated plates to produce ice-forming openings in the tray;

FIG. 2 is a cross-sectional view taken substantially along line 2—2 of FIG. 1;

FIG. 3 is a fragmentary cross sectional view taken substantially along line 3—3 of FIG. 1;

FIG. 4 is a plan view similar to FIG. 1 but showing a modified form of the present invention in which the longitudinal dividers are hollow diamond-shaped tubes;

FIG. 5 is a cross sectional view taken substantially along line 5—5 of FIG. 4; and FIG. 6 is a fragmentary cross sectional view taken substantially along line 6—6 of FIG. 4.

DESCRIPTION OF THE PREFERRED EMBODIMENTS

The improved ice cube forming tray 10 includes a plurality of corrugated plates 11 which are formed into alternating ridges and grooves 12 and 13, respectively, on one side and alternating ridges and grooves 14 and 15, respectively, on the opposite side. A plurality of first plates 16 are located between adjacent plates 11. In addition, a plurality of second plates 17, which are similar to plates 16, are located on the outer sides of outermost plates 11. Plates 11 in conjunction with the plates 16 and 17 provide a plurality of ice-cube forming openings on opposite sides of the tray 10. In this respect, openings 19 are bounded by walls 20 and 21 of corrugated plate 11 and by wall portions 22 of plates 16. The openings 18 between plates 11 and 16 and on the opposite side of plate 11 are formed by analogous structure. Openings which are analogous to openings 18 and 19 are also formed between outer plates 11 and plates 16 and 17. These openings on one side of the tray are designated by the numeral 19' and on the opposite side of the tray by numeral 18'.

As can be seen from FIG. 2, side walls 20 and 21 of corrugated plate 11 converge to form ridges 12 and 14. Located within the converging portions of walls 20 and 21 at ridges 12 are triangular-shaped evaporator tubes 23 which nest in complementary mating relationship in the apices formed by these walls. Likewise, evaporator tubes 24 which are triangular in cross section nest in complementary mating relationship between walls 20 and 21 at the apices formed at ridges 14. Triangular refrigerant-carrying tubes 23 and 24 pass through aligned triangular openings in each of plates 16 and 17, with which they fit in complementary mating relationship. A portion of plate 17 is shown in FIG. 1A to show the orientation of triangular openings 23' and 24', and a portion of plate 16 is shown in FIG. 1B with openings 23'' and 24'' which are aligned with openings 23' and 24'.

It will be appreciated that if plates 11 are corrugated in a configuration other than shown, the refrigerant-carrying conduits can be formed in cross sectional configurations other than triangular to provide the desired complementary mating relationship. For example, plates 11, instead of having peaks 12 and 14, may possibly be formed in the shape of a square-wave with sloping sides, in which event the tubes analogous to 23 and 24 would be trapezoidal in cross section and the openings in plates analogous to 16 and 17 would also be trapezoidal to accept the tubes in complementary mating relationship.

The portions of triangular tubes 24 outside of outer plates 17 are connected by return bends 25 on one side of the tray and by return bend 26 on the opposite side of the tray. Triangular refrigerant carrying evaporator tubes 23 are connected by return bends 27 on one side of the tray and by return bends 29 on the opposite side of the tray. The return bends may be attached to the straight portions of tubes 23 and 24 in any acceptable manner. Refrigerant is supplied to conduits 23 from inlet conduit 30 and is supplied to conduits 24 from inlet conduit 31.

At this point it is to be noted that the tray 10 includes the evaporator coils 23 and 24 of a refrigeration system, as is well known in the art. This system includes a compressor, condenser, expansion valve and evaporator, all connected in series. As is well understood when the evaporation occurs in the evaporator, which is essentially tray 10, freezing will be effected of the water which is splashed into openings on the opposite sides of tray 10 in any suitable manner. Conduits 30 and 31 are connected to the expansion valve, and outlet conduits 32 and 33 are connected to the compressor, conduit 32 being in communication with lowermost refrigerant conduit 23 and conduit 33 being in communication with lowermost refrigerant conduit 24.

By virtue of the fact that refrigerant carrying conduits 23 and 24 are in direct communication with the openings 18, 19, 18' and 19' in which ice cubes are formed, a highly efficient cooling of the water is obtained. In this respect, it is to be noted that the water is placed into these openings in any suitable manner, as by splashing, or by the use of suitable spray nozzles, or by directing a water stream downwardly on the ice cube forming tray 10 which is suspended vertically by means of hooks 34 formed at the upper ends of outer plates 17.

After the ice cubes have been fully formed in the openings 18, 19, 18' and 19', the refrigerant flow in the refrigerating system is reversed so that hot refrigerant flows directly to conduits 30 and 31 from the compressor, to thereby provide a defrost cycle which melts the part of the ice cubes adjacent the walls of the tray so that the ice cubes can be harvested. The freezing and defrost cycles can be adjusted by any suitable means, or suitable controls can be provided within the system, as is well known in the art, to effect harvesting at a predetermined part of the refrigerating cycle.

It will be appreciated that the tray 10 is relatively simple to fabricate in view of the fact that it is essentially constructed of aligned plates 16 and 17 which are oriented relative to corrugated plates 11 as shown in the drawings, with the refrigerant conduits 23 and 24 passing through openings 23', 24', 23'' and 24'', and nesting in complementary mating relationship in the apices formed by the converging side walls.

In FIGS. 4–6 a modified form of the present invention is disclosed. In this embodiment, plates 11', which are analogous to plates 11 of FIGS. 1–3 and which form ridges 12 and 14, have their outer edges of a configuration to fit in complementary mating relationship with the outer walls 42 at the outer edges of the tray and the vertical divider walls 35 between plates 11'. Walls 35 and 42 are shown as being diamond-shaped in cross section (FIG. 6). However, outer walls 42 only need to fit with plates 11' in complementary mating relationship, and therefore they need not be diamond-shaped and their outer surfaces on the opposite sides of plates 11' can be of any desired shape. The configuration of the outer edges of plates 11' can be visualized from FIGS. 4 and 6. The tops 23' of evaporator tubes 23 are in line with peaks 35' of divider walls 35 and peaks 42' of walls 42. Openings 36 in which ice cubes are formed are defined by sloping side walls 37, 39, 40 and 41. Openings 36' on the opposite side of the tray have analogous sloping side walls. The sloping side walls produce a draft on all four sides of each ice cube which is formed, and this enhances release of the cubes from the tray during the harvesting cycle. In addition, as can be visualized from FIGS. 4–6, practically all sides of each ice cube which is being formed is in direct contact with a tube, such as 23, 24, 35, and 42, which carries refrigerant. In this respect, as can be seen, tubes 24 carry refrigerant as do tubes 23. In addition, refrigerant is supplied to walls 35 and 42 from header 43 which is in communication with the expansion valve through conduit 44. Walls 35 and 42 are also in communication with outlet header 45 which leads to conduit 46 which is in communication with the compressor. Therefore, since a large portion of the walls of each opening in which each ice cube is formed is in direct contact with an evaporator coil, highly efficient freezing of water is obtained, as well as highly efficient defrosting, because there is relatively little heat transfer through walls which do not comprise the evaporator coil.

Walls 35 and 42 have triangular openings therein which are analogous to openings 23', 24', 23'' and 24'' of FIGS. 1A and 1B. It is through such aligned openings in walls 35 and 42 that refrigerant tubes 23 and 23 pass. Furthermore, as in the embodiment of FIGS. 1–3, return bends 25 and 26 connect tubes 24 and return bends 27 and 29 connect tubes 23. Suitable sealant is provided at the joints where the tubes 23 and 24 pass through members 35 and 42.

It can thus be seen that the improved ice cube forming tray of the present invention is manifestly capable of achieving the above-enumerated objects, and while preferred embodiments of the present invention have been disclosed, it will be appreciated that the present invention is not limited thereto but may be otherwise embodied within the scope of the following claims.

What is claimed is:

1. An ice cube forming tray for an ice making machine comprising a plurality of members each formed to provide a plurality of aligned openings with alternating openings facing in opposite directions, first plate means located between adjacent members to provide first side walls, second plate means located at opposite outer sides of said plurality of members to provide second side walls, and a plurality of refrigerant-receiving evaporator tubes passing through said first and second plate means and being located in and forming the bottoms of said openings to provide direct engagement with water in said openings.

2. An ice cube forming tray for an ice making machine as set forth in claim 1 wherein said first and second plate means are hollow for receiving refrigerant and functioning as evaporator tubes to provide direct engagement with water in said openings.

3. An ice cube forming tray for an ice making machine as set forth in claim 2 wherein said first and second plate means provide a draft to the sides of said openings.

4. An ice cube forming tray for an ice making machine as set forth in claim 3 wherein said openings are bounded by walls which produce a V-shaped form and wherein said evaporator tubes have diverging side walls for complementary mating engagement with the apices of said V-shaped forms.

5. An ice cube forming tray for an ice making machine as set forth in claim 4 wherein said evaporator tubes are triangular in cross section.

6. An ice cube forming tray for an ice making machine as set forth in claim 2 wherein said plurality of members are corrugated plates.

7. An ice cube forming tray for an ice making machine as set forth in claim 2 wherein said first plate means are of diamond shape in cross-section.

8. An ice cube forming tray for an ice making machine as set forth in claim 1 wherein said openings are bounded by walls which produce a V-shaped form and wherein said evaporator tubes have diverging side walls for complementary mating engagement with the apices of said V-shaped forms.

9. An ice cube forming tray for an ice making machine as set forth in claim 8 wherein said evaporator tubes are triangular in cross section.

10. An ice cube forming tray for an ice making machine as set forth in claim 1 wherein said plurality of members are corrugated plates for providing alternating ridges and grooves.

11. An ice cube forming tray for an ice making machine as set forth in claim 10 wherein said refrigerant-receiving evaporator tubes are located at the bottoms of said grooves.

12. An ice cube forming tray for an ice making machine comprising a member formed to provide a plurality of aligned openings with alternating openings facing in opposite directions, plate means located on opposite sides of said member to provide side walls, and a plurality of refrigerant-receiving evaporator tubes passing through said plate means and being located in and forming the bottoms of said openings to provide direct engagement with water in said openings.

13. An ice cube forming tray for an ice making machine as set forth in claim 12 wherein said plate means are hollow for receiving refrigerant and functioning as evaporator tubes to provide direct engagement with water in said openings.

14. An ice cube forming tray for an ice making machine as set forth in claim 13 wherein said plate means provide a draft to the sides of said openings.

15. An ice cube forming tray for an ice making machine as set forth in claim 14 wherein said openings are bounded by walls which produce a V-shaped form and wherein said evaporator tubes have diverging side walls for complementary mating engagement with the apices of said V-shaped forms.

16. An ice cube forming tray for an ice making machine as set forth in claim 13 wherein said members are corrugated plates.

17. An ice cube forming tray for an ice making machine as set forth in claim 13 wherein said first plate means are of diamond shape in cross-section.

18. An ice cube forming tray for an ice making machine as set forth in claim 12 wherein said openings are bounded by walls which produce a V-shaped form and wherein said evaporator tubes have diverging side walls for complementary mating engagement with the apices of said V-shaped forms.

19. An ice cube forming tray for an ice making machine as set forth in claim 12 wherein said member is a corrugated plate for providing alternating ridges and grooves.

20. An ice cube forming tray for an ice making machine as set forth in claim 19 wherein said refrigerant-receiving evaporator tubes are located at the bottoms of said grooves.

* * * * *